United States Patent [19]

Phillips

[11] 4,106,309

[45] Aug. 15, 1978

[54] ANALYZER AND RECTIFIER METHOD AND APPARATUS FOR ABSORPTION HEAT PUMP

[75] Inventor: Benjamin A. Phillips, Benton Harbor, Mich.

[73] Assignee: Allied Chemical Corporation, Morris Township, Morris County, N.J.

[21] Appl. No.: 796,631

[22] Filed: May 13, 1977

[51] Int. Cl.[2] ..... F25B 15/00; F25B 33/00

[52] U.S. Cl. ..... 62/476; 62/495; 62/497

[58] Field of Search ..... 62/476, 489, 497, 495

[56] References Cited

U.S. PATENT DOCUMENTS

| | | | |
|---|---|---|---|
| 2,191,551 | 2/1940 | Ullstrand | 62/476 |
| 3,236,064 | 2/1966 | Whitlow | 62/476 |
| 3,254,507 | 6/1966 | Whitlow | 62/476 |
| 3,270,516 | 9/1966 | McNeely | 62/101 |
| 3,270,522 | 9/1966 | McNeely | 62/476 |
| 3,270,523 | 9/1966 | McNeely | 62/476 |
| 3,279,204 | 10/1966 | Palmatier | 62/476 |
| 3,323,323 | 6/1967 | Phillips | 62/497 |
| 3,367,137 | 2/1968 | Whitlow | 62/497 |
| 3,516,264 | 6/1970 | Stierlin | 62/101 |
| 3,626,716 | 12/1971 | Leonard, Jr. | 62/476 |

*Primary Examiner*—Lloyd L. King

*Attorney, Agent, or Firm*—Alan M. Doernberg; Jay P. Friedenson

[57] ABSTRACT

A generator unit of an absorption heat pump includes a housing defining a lower boiler zone, a middle analyzer zone and a rectifier zone extending upwardly and outwardly from above the analyzer zone. A refluxer is located in the distal end of the rectifier zone. A weak liquor conduit extends upwardly from the boiler zone out of communication with, but in heat exchange relation with the analyzer zone.

14 Claims, 9 Drawing Figures

FIG. 1
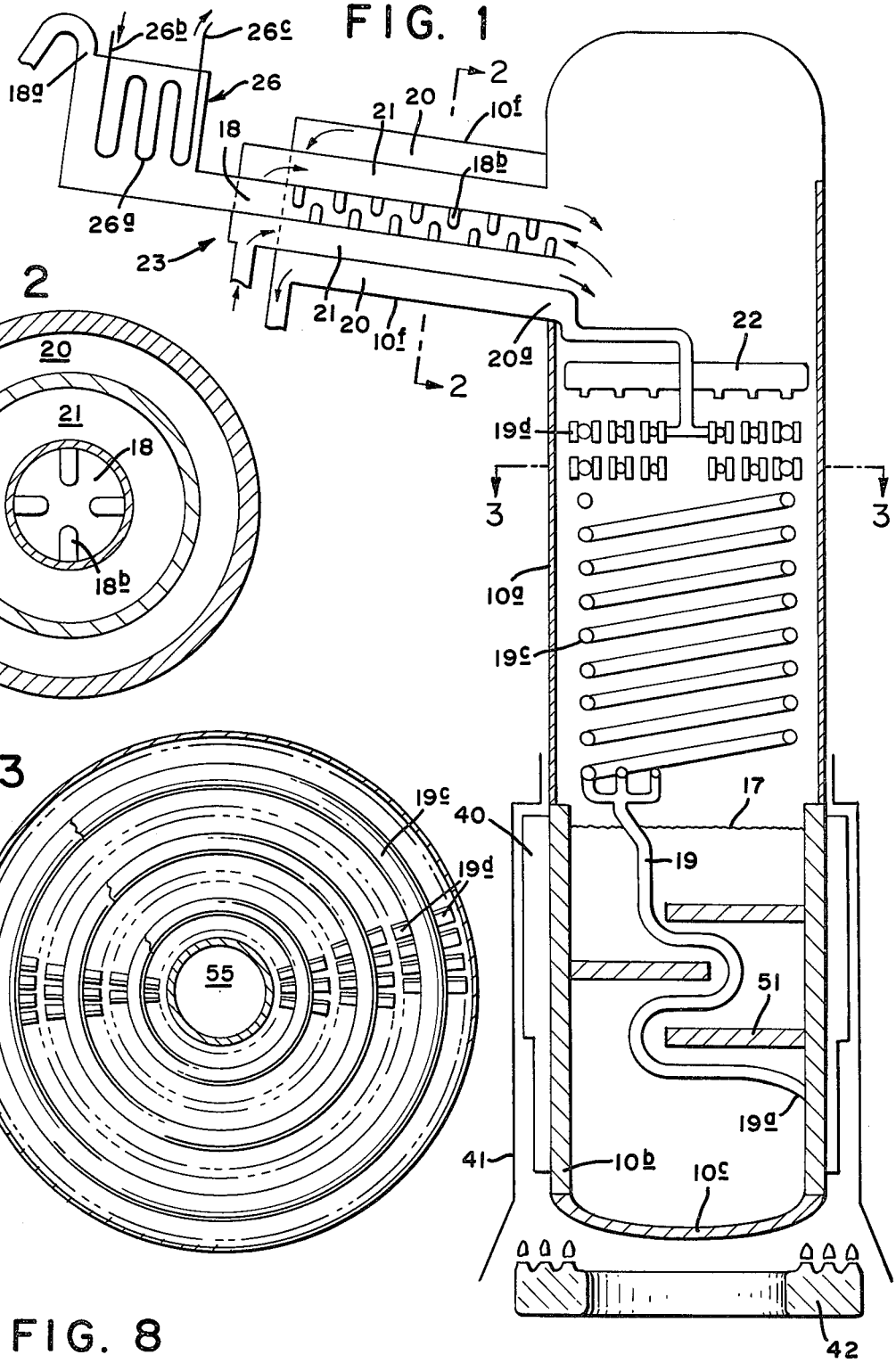
FIG. 2
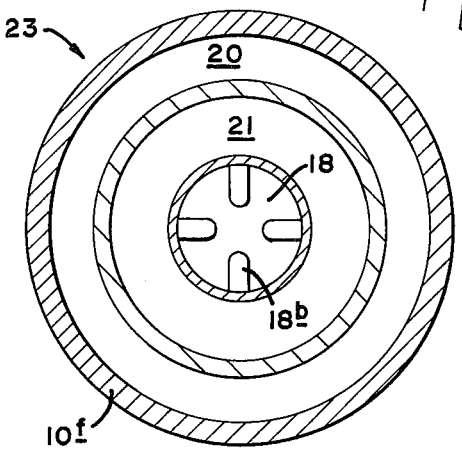
FIG. 3
FIG. 8
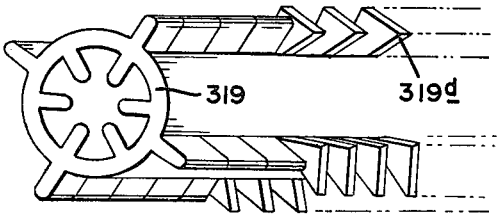
FIG. 6
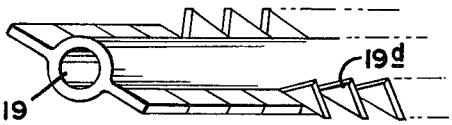

FIG. 7
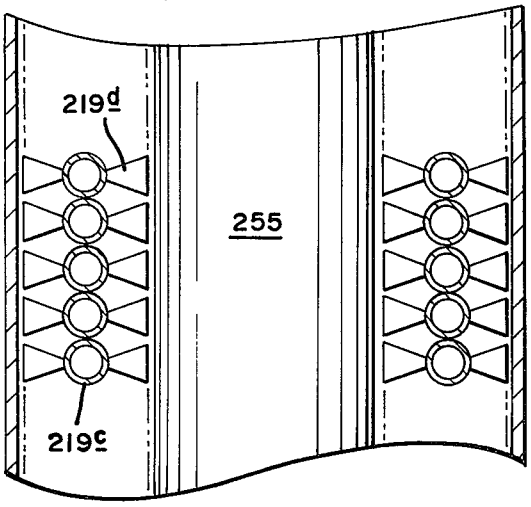
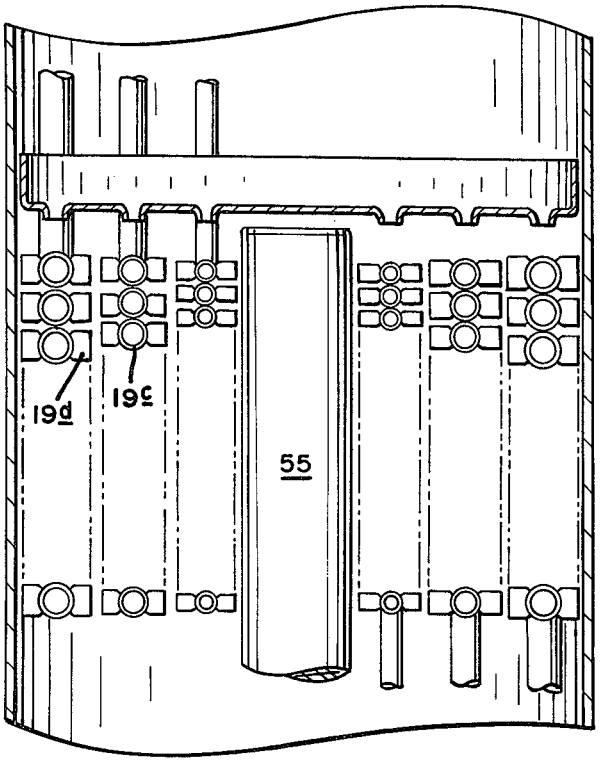
FIG. 4
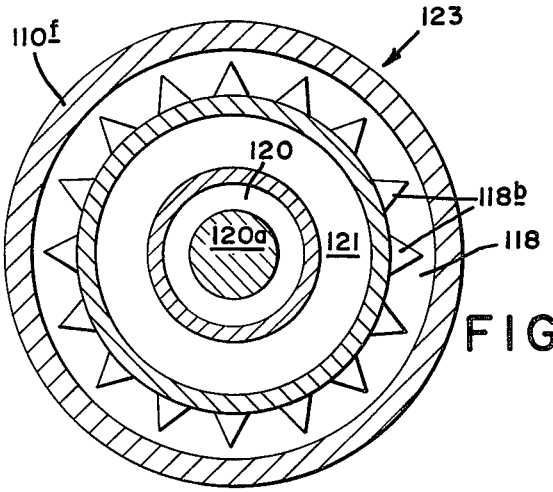
FIG. 5
FIG. 9
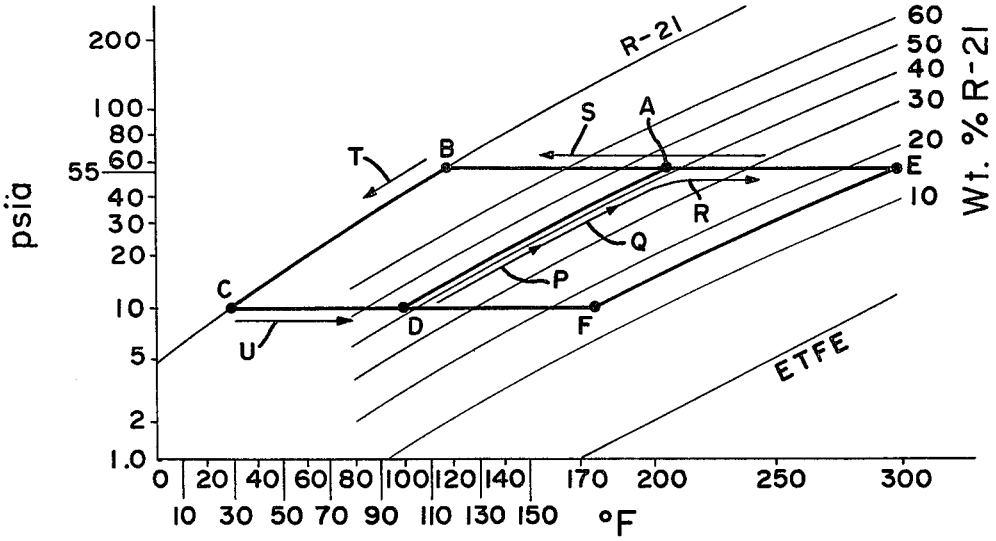

ANALYZER AND RECTIFIER METHOD AND APPARATUS FOR ABSORPTION HEAT PUMP

BACKGROUND OF THE INVENTION

Absorption refrigeration and heat pump systems are known including a generator unit having boiler, analyzer and rectifier portions. For example, U.S. Pat. No. 3,270,522 (Sept. 6, 1966 to McNeely) discloses a generator unit with an upwardly extending analyzer portion, a rectifier portion (or triple heat exchanger) extending outwardly from the top of the analyzer portion and a boiler (called the "generator") connected at the outside end of a separation chamber, which extends outwardly from the bottom end of the analyzer. A first coil extends from the reservoir helically upwardly through the analyzer and then outwardly through the rectifier (the first coil is called an inner heat exchange coil in the rectifier portion). An outer heat exchange coil surrounds the first coil in the rectifier portion dividing the rectifier into an interior weak liquor (called strong absorbent) outlet conduit, a rich liquor (called weak absorbent) inlet conduit, and an outermost refrigerment outlet conduit. Generator units of generally similar designs are disclosed in the following U.S. Patents:

| Number | Date | Inventor |
|---|---|---|
| 3,270,516 | September 6, 1966 | McNeely |
| 3,270,523 | September 6, 1966 | McNeely |
| 3,279,204 | October 18, 1966 | Palmatier |
| 3,626,716 | December 14, 1971 | Leonard |

Other references disclosing rectifiers of similar design include the following U.S. patents:

| Number | Date | Inventor |
|---|---|---|
| 2,191,551 | February 27, 1940 | Ullstrand |
| 2,201,362 | May 21, 1940 | Bergholm |
| 2,203,074 | June 4, 1940 | Anderson, Jr. |

U.S. Pat. No. 3,527,060 (Sept. 8, 1970 to Kruggel) discloses a generator unit having a reflux coil at it upper end but not a rectifier unit.

The present invention is designed to provide a maximum amount of heat exchange into the rich liquor under all operating conditions. The present invention is also designed to reduce the absorbent content of the refrigerent vapor leaving the generator while heating a coolant to a temperature approaching the minimum generator temperature and the maximum absorber temperature. The present invention is also designed to provide sufficient rectification of refrigerant vapor under all conditions. These goals are accomplished without reducing the differential between rich liquor concentration and weak liquor concentration and with a minimization of the boiler heat imput required to attain the concentration differential.

BRIEF DESCRIPTION OF THE INVENTION

The invention includes a generator unit for an absorption heat pump system comprising:

a. a housing defining an upstanding interior zone including a boiler zone and an analyzer zone above the boiling zone, and also defining a rectifier zone slanting upwardly and outwardly from adjacent said interior zone above said analyzer zone to a distal end; said rectifier zone being divided into three conduits, a first conduit being a weak liquor outlet conduit, a second conduit being a rich liquor inlet conduit and a third conduit being a refrigerant outlet conduit, with said second conduit being in heat exchange relation with said first and third conduits;

b. a fourth conduit being a weak liquor conduit extending from said boiling zone to an end of said first conduit proximal said interior zone, the interior of said fourth conduit being out of communication with and in heat exchange relation with said analyzer zone and said second and third conduits communicating with said interior zone whereby rich liquor and refrigerant vapor in said analyzer zone are in heat and mass exchange relation with each other and in heat exchange relation with weak liquor in said fourth conduit;

c. boiler means in said boiler zone for evaporating refrigerant into said interior zone from rich liquor containing refrigerant in said boiler zone and for propelling weak liquor depleted of refrigerant into the lower end of said fourth conduit and through said fourth conduit and first conduit; and d. reflux means in said third conduit adjacent an end of said rectifier zone distal said interior zone for withdrawing heat from refrigerant vapor and condensing absorbent vapor, said third conduit being slanted to permit condensed absorbent to flow in a downward path into said interior zone.

The invention also includes a generator unit for an absorption heat pump system for generating refrigerant vapor and weak liquor from rich liquor comprising:

a. a housing defining an upstanding interior zone including a boiler zone and an analyzer zone above the boiler zone and means in said boiler zone for distilling a refrigerant from a solution of refrigerant in absorbent to generate a weak liquor and refrigerant vapor;

b. a weak liquor conduit extending from said boiler zone to an outlet conduit above the analyzer zone for receiving weak liquor and extending through said analyzer zone through a coil portion which includes a plurality of vertically-spaced parallel tubular portions;

c. a rich liquor inlet above said analyzer zone communicating with said interior space for supplying rich liquor to said interior zone; and d. distributor means above said analyzer zone and below said rich liquor inlet for directing rich liquor into said parallel tubular portions;

each of said tubular portions having fin means for promoting heat exchange between weak liquor within each said tubular portion and rich liquor on said tubular portion, for promoting mass and heat exchange between refrigerant vapor and the rich liquor and, except for the lowermost tubular portion, for directing said rich liquor onto a lower tubular portion.

BRIEF DESCRIPTION OF THE DRAWING

FIG. 1 is a front elevational view in section of a generator unit of a heat pump system according to a first embodiment of the present invention;

FIG. 2 is a view taken along line 2—2 in FIG. 1;

FIG. 3 is a top plan view taken along line 3—3 in FIG. 1;

FIG. 4 is an enlarged front elevation view of the analyzer portion of the generator unit of FIG. 1;

FIG. 5 is a view similar to FIG. 2 of the rectifier portion of a generator unit according to a second embodiment of the present invention;

FIG. 6 is a highly enlarged perspective view in section of a tube used in the generator unit of FIG. 1;

FIG. 7 is an enlarged front elevation view of the analyzer portion of a generator unit according to a third embodiment of the present invention;

FIG. 8 is a highly enlarged perspective view of a tube which can be used in a generator unit according to the present invention;

FIG. 9 is a temperature-concentration graph illustrating the operation of the generator of the present invention.

DETAILED DESCRIPTION OF THE INVENTION

Absorption systems can use a liquid heat exchanger (between the generator and absorber for preheating rich liquor with weak liquor) and can use an absorption heat exchanger (within or separate from the absorber for preheating rich liquor with absorbing fluid). The provision of both (or of an absorption heat exchanger and a triple heat exchanger) increases efficiency over a full range of operating conditions, from cooling to pumping heat from low temperature ambient air. It should be appreciated that the provision of this combination (as described in copending application Ser. No. 796,773, filed May 13, 1977,) permits the system to operate as an absorber heat exchanger cycle while operating as an air conditioner or when heat pumping at mild outdoor temperatures, and also to operate as a liquid heat exchanger cycle when operating at extreme temperatures.

The combination of an absorber heat exchanger with a triple exchanger with very effective liquid heat exchange surface has been developed to accomplish this group of effects.

When operating conditions are mild the absorber heat exchanger takes the primary role. The liquid heat exchange and rectification requirements of the triple exchanger are relatively minor. However, the reflux coil assumes a major rectification function under mild conditions. When heat pumping from low outdoor temperatures, the liquid heat exchanging and rectification in the triple exchanger becomes the critical effect while the absorber heat exchange effect takes on a secondary role.

The shifting in the relative importance of the two exchange effects occurs by the interrelationship of components and sizing of heat and mass transfer surface.

The triple exchanger is designed so as to have sufficient capacity for the cold temperature operation. The absorber heat exchanger surfaces in the absorber and generator are provided in sufficient quantity so that the absorber heat exchanger effects will take precedence whenever the operating conditions are sufficiently mild for that to be preferably.

It is preferred that the fourth conduit include an analyzer coil extending upwardly through said analyzer zone in a tortuous path and the generator unit further comprise distributor means in said interior zone above said analyzer zone for distributing rich liquor coming from said third conduit over and in heat exchange relation with said analyzer coil. In some preferred forms said analyzer coil is provided with outwardly extending heat exchange fins for promoting heat exchange with the rich liquor. In some preferred forms the fourth conduit includes a plurality of analyzer coils in said analyzer zone which are joined at a top manifold adjacent said distributor means and connected from said top manifold to the proximal end of said first or weak liquor outlet conduit. In some of the preferred forms of the immediately preceding sentence either (1) the analyzer coils are joined at their lower ends to form a lower weak liquor conduit portion or (2) the fourth conduit includes a plurality of inlet portions extending upwardly from a plurality of lower ends each in communication with said boiler means. In many preferred forms, the rectifier zone (also called the triple exchanger) includes a plurality of cylindrical, heat conductive baffles dividing said rectifier zone into three concentric conduits, with said second conduit being between the first conduit and the third conduit, the first and third conduits each having an outlet adjacent an end of said rectifier zone distal said interior zone and the second conduit having an inlet adjacent the distal end. Three preferred variations are those in which (1) the third conduit is provided with turbulence means for creating turbulence of refrigerant vapor and increasing heat exchange with said second conduit or (2) the third conduit is exteriorly spaced from said second conduit and said first conduit is interiorly spaced from said rich liquor inlet conduit or (3) the third conduit is interiorly spaced from second conduit and said first conduit is exteriorly spaced from said second conduit. Variation 1 may be combined with variation 2 (as in FIG. 5) or with variation 3 (as in FIGS. 1 and 2).

It is also preferred that the coil portion comprise a first coil extending helically upward within a first cylindrical annular zone and said distributor means comprises a plate extending across said interior zone defining a first plurality of circumferentially spaced apertures above said first cylindrical annular zone.

In some of the preferred forms, said coil portion further comprises a second coil extending helically upward within a second cylindrical annular zone concentric with said first cylindrical annular zone and said plate defines a second plurality of circumferentially spaced apertures above said second cylindrical analyzer zone.

It is also preferred that the fin means comprise a plurality of fins extending diagonally upward from said tubular units, said fins being spaced horizontally along said tubular conduits.

DESCRIPTION OF THE PREFERRED EMBODIMENTS

A generator unit 10 according to a first embodiment of the present invention is illustrated in FIGS. 1, 2, and 3. Referring to FIG. 1, the generator 10 can be seen to include an upstanding, generally cyclindrical housing with a main housing portion 10*a*, a lower side wall portion or boiler wall 10*b* and a bottom wall 10*c*. The boiler wall 10*b* extends upwardly from the top of the dish-shaped bottom wall 10*c* about a third of the way up the boiler 10 to its junction with the main housing portion 10*a*. A plurality of fins 50 extend outwardly from the boiler wall 10*b* and are surrounded by an insulation housing 41 which extends below and outside the bottom wall 10*c*. A gas or oil ring burner 42 is positioned beneath and outside the bottom wall 10*c* for directing hot combustion gases between the boiler wall 10*b* and insulation housing 41 and transmitting heat through the fins 40 into the boiler wall 10*b*. This heat may be used to boil solution in a pool 17 of rich liquor by pool boiling; but, preferrably, the rich liquor is boiled in pump tubes within the boiler wall 10*b* as described in my copending, commonly assigned application, "Method and Generator Unit of an Absorption Heat Pump System for Separating a Rich Liquor into a Refrigerant and a Solution Low in Refrigerant Content," Ser. No. 796,493, filed May 12, 1977 which is incorporated herein by reference.

A weak liquor conduit 19 (or fourth conduit) extends from within the boiler zone partially enclosed by the boiler wall 10*b* and bottom wall 10*c* to an outlet near the top of boiler 10. Specifically, a weak liquor conduit lower inlet 19*a* receives weak liquor (solution depleted of refrigerant) from a weak liquor reservoir adjacent the boiler wall (the detail of this structure is shown in my above-referenced application) and the conduit 19 extends upwardly therefrom. The conduit from inlet 19*a* may be straight, but will preferably wind, spiral or weave between baffles 51 in the boiler zone as described in my copending application Ser. No. 796,493. The weak liquor conduit splits at the top of the boiling zone into three portions 19*c* which coil helically through an analyzer zone within the main housing portion 10*a*, above the boiler zone and below a distributor plate 22. The plate 22 located within the main housing portion 10*a* slightly higher than two thirds of the way up the boiler 10. The portions 19*c* will be called analyzer coils 19*c* although they also include short conduit sections above and below the actual helical coils. A blank tube 55 occupies the center of the analyzer zone, as is best shown in FIGS. 3 and 4.

Above distributor plate 22, the main housing portion 10*a* has a generally circular aperture into which is fitted a rectifier housing or wall 10*f* which may be considered a part of the housing of the generator 10 and is generally cyclindrical in shape. The zone within the housing 10*f* will be called the rectifier zone 23. The wall 10*f* extends from a proximal end sealably fitted within the circular aperature in the main housing portion 10*a* upwardly and outwardly to a distal end which will be referred to as the reflux zone 26. As shown in FIGS. 1 and 2, two concentric baffles or tubes, within and generally concentric with the wall 10*f*, divide the recifier zone 23 into three conduits 18, 20 and 21. The outermost or first conduit 20, called the weak liquor outlet conduit, is sealed at both its ends except for an inlet at its proximal end, which is connected by short conduit 19*e* to a manifold connecting all three analyzer coils 19*c* and except for outlet 20*b* near its distal end, which in operation would be connected to the weak liquor inlet of the absorber unit of the system. The short conduit 19*e* passes through an aperture in the center of the distributor plate 22.

Again within the rectifier zone 23, the middle conduit in from the weak liquor outlet conduit 20 is the second conduit 21 which will be referred to as the rich liquor inlet conduit. This conduit 21 is open at its proximal end to the interior zone within main housing portion 10*a* and is closed at its distal end except for an inlet 21*a* which in operation will be connected to the rich liquor outlet of the absorber unit. Both the weak liquor outlet conduit 20 and the rich liquor inlet conduit 21 stop at their distal ends short of the distal end of the rectifier 23.

The innermost or third conduit 18 in the rectifier 23 is referred to as the refrigerant vapor outlet conduit or refrigerant outlet conduit. This conduit 18 is open at its proximal end to the interior space within main housing portion 10*a*. At its distal end, beyond the distal ends of the other conduits 20 and 21, the refrigerant outlet conduit 18 widens upwardly to form a reflux zone 26 with a reflux coil 26*a* therein. Fins 18*b* or other equivalent means to promote turbulence of refrigerant vapor are located within conduit 18. A coolant coil inlet conduit 26*b* and outlet conduit 26*c* extend from the coil 26*a* through the housing 10*f*.

In operation the inlet conduit 26*b* is connected to a coolant outlet of the absorber unit or condenser unit and the outlet conduit is connected to a valve which causes it to communicate indirectly with either an ambient air heat exchanger or a basement heat exchanger or the like. Preferred heat pump systems with these conditions made are described in my copending, commonly assigned application, "Improved Heat Activated Absorption Heat Pump Apparatus and Method", filed herewith, Ser. No. 796,773, filed May 13, 1977.

The reflux zone 26 includes a refrigerant vapor outlet 18*a* communicating with an upper area of the zone. the wall 10*f* and various baffles of the rectifier 23 form a downward sloping path along the bottom of the refrigerant outlet cnduit 18 from the lower portion of the reflux zone 26 into the interior zone within main housing portion 10*a*. The downwardly sloping path may be convoluted, grooved or otherwise arranged, but is preferably linear as shown in FIG. 1.

In operation, relatively cool rich liquor containing a high refrigerant content enters the generator 10 from the absorber unit from which it is pumped through the inlet 21*a* and rich liquor inlet conduit 21. Within conduit 21 the rich liquor is heated by heat exchange with the fluids in conduits 18 and 20 with which conduits it is out of communication. At the proximal end of the rectifier 23, the rich liquor spills into the top portion of the interior space where it mixes with outgoing refrigerant vapor before passng through distributor plate 22 and over the analyzer coils 19*c*. The rich liquor is further heated by heat exchange with the interior of the analyzer coils 19*c*, as promoted by the fins 19, while still mixing with refrigerant vapor rising within the interior zone. The "rich" liquor (actually partially depleted of refrigerant) then falls into the reservoir 17 in the boiler zone surrounded in part by the boiler wall 10*b* and bottom wall 10*c*. It is boiled at the boiler wall, as described in above-referenced application Ser. No. 796,493. The refrigerant vapor bubbles are released (preferrably through the reservoir pool 17) into the interior zone, and the weak liquor flows up into the weak liquor conduit 19.

Weak liquor, containing a particularly low refrigerant content because of the high maximum boiler temperature near the inlets 19*a*, passes upwardly through and in heat exchange relation with the reservoir pool 17. Weak liquor then passes upwardly through analyzer coils 19*c* where much of its heat is dissipated to incoming rich liquor with the assistance of the fins 19*c*. Weak liquor then passes through the short conduit 19*e* and inlet 20*a* into the weak liquor outlet conduit 20 where still more heat is given up to incoming rich liquor. Weak liquor then passes out through oulet 20*b* to the absorber unit. Since it is out of communication with rich liquor and refrigerant throughout conduits 19 and 20, the weak liquor will maintain the extremely low refrigerant concentration determined by the high peak temperature near inlet 19*a*. However, the extensive and continuous heat exchange with rich liquor while the weak liquor is in conduits 19 and 20 causes the high heat content of the weak liquor to be reused within the generator 10 by preheating rich liquor and depleting it somewhat of refrigerant and not to be lost in the conduit between the generator 10 and the absorber.

The refrigerant vapor being formed adjacent the wall of the reservoir pool 17 near outlet 19*a* is at or near the peak boiler temperature. It therefore may contain a substantial amount of evaporated absorbent and also a substantial amount of heat that can be used to advantage to preheat rich liquor. The refrigerant vapor rises slowly through the reservoir pool 17 between baffles 51 thereby releasing some of its excess heat and absorbent content to the rich liquor. The vapor then rises through the analyzer zone and distributor plate where further heat exchange and condensation of absorbent occurs. Within the top of the interior space above the distributor plate 22, the vapor mixes with cooler rich liquor thereby giving up still more of its heat and absorbent content. The vapor passes into the proximal end of the refrigerant outlet conduit 18 where it is made turbulent by fins 18*b* so as to efficiently transfer heat through the surrounding baffles to the incoming rich liquor. In the reflux zone 26*a* it dissipates more heat to coolant within coolant coil 26*a* before passing out of the generator 10 through the outlet 18*a*.

Thus, the reflux zone performs a heat exchange function similar to that performed in the reservoir, analyzer and rectifier zones.

The presence of reflux coil 36 at the end of the triple heat exchanger 23 permits condensate from the reflux coil to serve as the reflux fluid for improved rectification in the conduit 18 of triple exchanger 23. The control of the temperature at the end of the triple exchanger serves as an "anchor point" to help establish a temperature gradient through the triple exchanger 23. In addition, when operating under mild conditions of cooling or heating and the absorber heat exchanger is doing essentially all of the heating of rich liquid that is required, then the liquid heat exchange within the triple exchanger is essentially nil (the rich liquor being too hot). Under those conditions, sufficient rectification (stripping of absorbent from refrigerant vapor) depends upon the reflux condenser and the condensate therefrom. Because of the downwardly sloping refrigerant vapor outlet conduit 18, the absorbent which does condense in conduit 18, principally at the reflux coil 26, will flow back into the interior zone where it will mix with rich liquor and refrigerant vapor.

The overall effect of the system is to establish a temperature and concentration gradient of rich liquor from inlet 21*a* to reservoir 17 which represents substantially the saturation or equilibrium concentration at each temperature throughout most of the interior space within main housing portion 10*a*. As described in copending application Ser. No. 796,493, these gradients continue through the reservoir pool 17 and the pump tubes in boiler wall 10*b* to the inlets 19*a* of the weak liquor conduit 19. Since, however, the pump tubes are continually discharging weak liquor having a large absorbent content and a small refrigerant content out through weak liquor conduit 19, the overall condition is one of steady state. Rich liquor is received from the absorber through the inlet 21*a*, weak liquor is returned to the absorber through conduits 19 and 21 and refrigerant vapor is transferred to the condenser at high purity through conduit 18 and outlet 18*a*. The concentration-temperature equilibrium at most points along the gradient represent a close approximation of "reversible" conditions in the thermodynamic sense with the result of a higher efficiency.

A second embodiment of the invention is illustrated in FIG. 5 which is a view similar to FIG. 2. Except for the rectifier section 123, illustrated therein, the generator of the second embodiment is identical to generator 10. Here the first or weak liquor outlet conduit 120 is on the inside with an innermost baffle or blank tube 120*a*. The outermost conduit is the third or refrigerant outlet conduit 118 provided with fins 118 extending outwardly therein to increase turbulence and heat exchange. Concentrically between the conduits 118 and 120 is the second or rich liquor inlet conduit 121 in heat exchange relation with, but out of communication with, the other conduits 118 and 120. It will be appreciated that the refrigerant outlet conduit 118, although now outermost, still extends beyond the other two conduits in the distal direction to form a reflux zone similar to zone 26 in FIG. 1.

The second embodiment of the rectifier portion 123 offers several advantages over the rectifier portion 23. Because the refrigerant vapor outlet conduit is on the outside, it has the largest surface of the three conduits. This permits the fins 118*b* to establish the most turbulence and heat dissipation therefrom. Further, the condensate from the fins and from the reflux coil flows along the bottom of housing 110*f* exposing a broader surface to the vapor. This arrangement permits some heat condensation by the wall 110*f* from hotter condensate (more proximal or toward the main housing) to cooler condensate (more distal or toward the refluxer), evaporating refrigerant from the more distal condensate, thus promoting rectification. The principle disadvantage of the rectifier 123 is the otherwise wasted space caused by blank tube 120*a*. The provision of blank tube 120*a* is a means to increase the surface of the weak liquor outlet conduit 120 for inceasing heat transfer to the rich liquor. Fins or other heat transfer promotion means may be used to permit the reduction in size or elimination of the blank tube 120*a*.

Although the present invention is not limited as to choice of materials, aluminum or aluminum alloys are preferred for the walls 10*a*, 10*b*, 10*c* and 10*f*, for the baffles in rectifier 23 or 123 and the baffles 51, for fins 40, 19*d*, 18*b* and 118*b*, for most portions of the conduit 19, for blank tube 120*a* and for the reflux coil 26*a*. Aluminum and aluminum alloys provide compatability with R21-ETFE, extrudability, ease of fabrication, light weight and good heat transfer. Of course the wall portions 10*a*, 10*f* and 110*f* will have outside insulation to avoid heat loss from within the generator 10 to the surrounding atmosphere. The inner surface of the insulation housing 41 is preferably of a high temperature, corrosion resistant ceramic or refractory material of relatively low thermal conductivity such as calcium-magnesium silicates. The refractory material may, for example, be WRP-X-AQ Felt 2300° ceramic fiber insulation from Refractory Products Company of Carpentersville, Ill. (see U.S. Pat. No. 3,092,247) in turn covered with thermal insulation material known as "kao-wool".

The construction of the tube 19 and fins 19*a*, as can be seen in FIG. 6, is designed to ensure maximum heat exchange and mass-transfer between exiting vapor and entering solution and to ensure maximum heat exchange between entering rich liquor and exiting weak liquor (within the tubes). The fins 19*d* are formed, as by extrusion, in two or more rows projecting outwardly from the tube 10 in a sidewise direction. The slits between adjacent fins may be formed after extrusion. Each fin 19*d* is bent upward so that it projects outwardly and upwardly from the tube 19. Each fin 19*d* is also twisted so as to have one outer corner above the original plane and another in or below the original plane.

In operation, the fins 19*d* will create turbulence in vapor rising around tubes 19 and provide a large wetted surface for contact between falling liquid and rising vapor. It will also direct rich liquor from the distributor 22 falling onto the tubes to be directed inward toward the tubes 19 over the fins 19*d* so as to promote maximum heat exchange with the hot weak liquor inside. The inward motion causes rich liquor to fall onto the next lowermost tube portions as well. The result is also to create maximum contact between rich liquor and refrigerant vapor at each point so as to create a dynamic steady state condition overall and gas-liquid equilibrium at each point with absorbent condensing into the liquid phase and refrigerant evaporating into the gas phase. This close approach to equilibrium conditions improves the overall efficiency of the system.

The embodiment of FIG. 7 differs from the first embodiment only in having a single coil of tube 219 with fins 219*d* in the analyzer portion within main housing portion 210*a*. A baffle or blank tube 219*f* is centrally located within the analyzer portion. This embodiment has particular application with some absorption pairs such as ammonia-water and in systems of small capacity.

FIG. 8 shows a modified tube 319 for the weak liquor conduit. Here the fins 219*d* are formed, as by extrusion, projecting into the interior of the tube as well as outward (now in four directions instead of just sidewise). The fins 319*d* may be twisted on the outside only to promote mass transfer and heat exchange. With closely packed tubes, the rich liquor flowing off a higher coil will necessarily fall onto another coil or fin portion below for more heat and mass exchange.

Another modified system is one in which the reflux coil (26*a* in FIG. 1) is in a separate reflux housing near the distal end of the rectifier unit with an upper connecting conduit (for the flow of refrigerant vapor) and a lower connecting conduit (for the return flow of condensate) therebetween. The outlet of the reflux housing would be near its upper end so as to permit only uncondensed vapor to escape. The lower connecting conduit would preferably have a bottom inside surface which, together with the bottom inside surface of the reflux housing and refrigerant outlet passage (of the rectifier section), would slope downward toward the main generator housing so as to flow condensate in counterflow to the vapor.

Many other deletions, additions and modifications may be made in the above-described embodient without departing from the spirit and scope of the present invention as set forth in the claims that follow.

What I claim is:

1. A generator unit for an absorption heat pump system comprising:

a. a housing defining an upstanding interior zone including a zone boiler being a reservoir zone for a rich liquor solution of absorbent and refrigerant and an analyzer zone above the boiler zone, and also defining a rectifier zone slanting upwardly and outwardly from adjacent said interior zone above said analyzer zone; said rectifier zone being divided into three conduits, a first conduit being a weak liquor outlet conduit, a second conduit being a rich liquor inlet conduit and a third conduit being a refrigerant outlet conduit with said second conduit being in heat exchange relation with said first and third conduits;

b. a fourth conduit being a weak liquor conduit extending from said boiler zone to an end of said first conduit proximal said interior zone, the interior of said fourth conduit being out of communication with and in heat exchange relation with said analyzer zone, and said second and third conduits communicating with said interior zone whereby rich liquor and refrigerant vapor in said analyzer zone are in heat and mass exchange relation with each other and in heat exchange relation with weak liquor in said fourth conduit;

c. boiler means in said boiler zone for evaporating refrigerant into said interior zone from rich liquor containing refrigerant in said boiler zone and for propelling weak liquor depleted of refrigerant into the lower end of said fourth conduit and through said fourth conduit and first conduit; and d. reflux means in said third conduit adjacent an end of said rectifier zone distal said interior zone for withdrawing heat from refrigerant vapor and condensing absorbent vapor, said third conduit being slanted to permit condensed absorbent to flow in a downward path into said interior zone.

2. The generator unit of claim 1 wherein said fourth conduit includes an analyzer coil extending upwardly through said analyzer zone in a tortuous path and said generator unit further comprises distributor means in said interior zone above said analyzer zone for distributing rich liquor coming from said third conduit over and in heat exchange relation with said analyzer coil.

3. The generator unit of claim 2 wherein said analyzer coil is provided with outwardly extending heat exchange fins for promoting heat exchange with the rich liquor.

4. The generator unit of claim 2 wherein said fourth conduit includes a plurality of analyzer coils in said analyzer zone which are joined at a top manifold adjacent said distributor means and connected from said top manifold to the proximal end of said weak liquor inlet conduit.

5. The generator unit of claim 4 wherein said analyzer coils are joined at their lower ends to form a lower weak liquor conduit portion.

6. The generator unit of claim 4 wherein said fourth conduit includes a plurality of inlet portions extending upwardly from a plurality of lower ends each in communication with said boiler means.

7. The generator unit of claim 1 wherein said rectifier zone includes a plurality of cylindrical, heat conductive baffles dividing said rectifier zone into three concentric conduits, with said second conduit being between the first conduit and the third conduit, the first and third conduits each having an outlet adjacent and end of said rectifier zone distal said interior zone and the second conduit having an inlet adjacent the distal end.

8. The generator unit of claim 7 wherein said third conduit is provided with turbulence means for creating turbulence of refrigerant vapor and increasing heat exchange with said second conduit.

9. The generator unit of claim 7 wherein said third conduit is exteriorly spaced from said second conduit and said first conduit is interiorly spaced from said rich liquor inlet conduit.

10. The generator unit of claim 7 wherein said third conduit is interiorly spaced from second conduit and said first conduit is exteriorly spaced from said second conduit.

11. A generator unit for an absorption heat pump system for generating refrigerant vapor and weak liquor from rich liquor comprising:

a. a housing defining an upstanding interior zone including a boiler zone and an analyzer zone above the boiler zone and means in said boiler zone for distilling a refrigerant from a solution of refrigerant in absorbent to generate a weak liquor and refrigerant vapor;

b. a weak liquor conduit extending from said boiler zone to an outlet conduit above the analyzer zone for receiving weak liquor and extending through said analyzer zone through a coil portion which includes a plurality of vertically-spaced parallel tubular portions;

c. a rich liquor inlet above said analyzer zone communicating with said interior space for supplying rich liquor to said interior zone; and d. distributor means above said analyzer zone and below said rich liquor inlet for directing rich liquor into said parallel tubular portions;

each of said tubular portions having fin means for promoting heat exchange between weak liquor within each said tubular portion and rich liquor on each said tubular portion, for promoting mass and heat exchange between refrigerant vapor and the rich liquor and, except for the lowermost tubular portion, for directing said rich liquor onto a lower tubular portion.

12. The generator unit of claim 11 wherein said coil portion comprises a first coil extending helically upward within a first cylindrical annular zone and said distributor means comprises a plate extending across said interior zone defining a first plurality of circumferentially spaced apertures above said first cyclindrical annular zone.

13. The generator unit of claim 12 wherein said coil portion further comprises a second coil extending helically upward within a second cylindrical annular zone concentric with said first cylindrical annular zone and said plate defines a second plurality of circumferentially spaced apertures above said second cylindrical analyzer zone.

14. The generator unit of claim 11 wherein said fin means comprise a plurality of fins extending diagonally upward from said tubular units, said fins being spaced horizontally along said tubular conduits.

* * * * *